US010202791B1

(12) United States Patent
Jean et al.

(10) Patent No.: US 10,202,791 B1
(45) Date of Patent: Feb. 12, 2019

(54) ADJUSTABLE POSITIONING HINGE WITH HIGH TORSIONAL FRICTION AND ASSEMBLING METHOD THEREOF

(71) Applicant: Wen-Fong Jean, Taoyuan (TW)

(72) Inventors: Wen-Fong Jean, Taoyuan (TW); Tai-Lien Huang, Taoyuan (TW); Yuen-Nu Lu, Taoyuan (TW)

(73) Assignee: Wen-Fong Jean, Taoyuan (TW)

( * ) Notice: Subject to any disclaimer, the term of this patent is extended or adjusted under 35 U.S.C. 154(b) by 0 days.

(21) Appl. No.: 15/715,870

(22) Filed: Sep. 26, 2017

(30) Foreign Application Priority Data

Aug. 1, 2017 (TW) ..... 106125858 A

(51) Int. Cl.
*E05D 11/08* (2006.01)

(52) U.S. Cl.
CPC ..... *E05D 11/082* (2013.01)

(58) Field of Classification Search
CPC ..... G06F 1/1681; G06F 1/1616; E05Y 2900/606; E05Y 2201/26; H04M 1/0216; E05D 11/082; E05D 11/084; E05D 11/085; E05D 3/02; E05D 5/14; E05D 2005/145; F16C 11/04
See application file for complete search history.

(56) References Cited

U.S. PATENT DOCUMENTS 5,542,505 A * 8/1996 Kempf ..... E05D 11/084 16/308
5,950,281 A * 9/1999 Lu ..... G06F 1/1616 16/337
6,301,748 B1 * 10/2001 Su-Man ..... G06F 1/1616 16/337
6,467,129 B1 * 10/2002 Bae ..... B60J 3/0265 16/308
7,124,473 B2 * 10/2006 Lu ..... G06F 1/1616 16/342
7,451,522 B2 * 11/2008 Lu ..... E05D 11/02 16/342

(Continued)

FOREIGN PATENT DOCUMENTS

CN 1110054 A 10/1995
CN 1202214 A 12/1998

(Continued)

*Primary Examiner* — Chuck Y Mah

(74) *Attorney, Agent, or Firm* — Kirton McConkie; Evan R. Witt

(57) ABSTRACT

An adjustable positioning hinge and an assembling method thereof are provided. The adjustable positioning hinge includes a first leaf set, a second leaf set, plural friction damping pieces, a positioning pin and a shaft. The first leaf set includes a first sleeve with a positioning groove concavely formed and disposed along an axial direction of the first sleeve. The plural friction damping pieces are fitted in the first sleeve and configured to form at least one adjustable sleeve set. Each of the plural damping pieces includes a positioning part engaged with the positioning pin accommodated in the positioning groove. The shaft is fixed to the second leaf set. The first leaf set is pivotally connected with the second leaf set via the shaft and the plural friction damping pieces, so that the first leaf set and the second leaf set are rotatable and positioned relative to each other.

20 Claims, 9 Drawing Sheets

(56) References Cited

U.S. PATENT DOCUMENTS

| | | | | |
|---|---|---|---|---|
| 2002/0162191 | A1* | 11/2002 | Chen | G06F 1/1616 16/337 |
| 2004/0049883 | A1* | 3/2004 | Huang | G06F 1/1616 16/295 |
| 2007/0101543 | A1* | 5/2007 | Lu | G06F 1/1616 16/342 |
| 2008/0312001 | A1* | 12/2008 | Lee | E05D 5/12 464/180 |
| 2009/0178501 | A1* | 7/2009 | Lee | H04M 1/0216 74/25 |
| 2009/0311073 | A1* | 12/2009 | Lee | E05D 11/087 411/209 |
| 2011/0239408 | A1* | 10/2011 | Chang | G06F 1/1681 16/386 |

FOREIGN PATENT DOCUMENTS

| | | | | |
|---|---|---|---|---|
| CN | 203603663 | U | | 5/2014 |
| CN | 104937202 | A | | 9/2015 |
| JP | 2003254323 | A | * | 9/2003 |
| JP | 2003269437 | A | * | 9/2003 |
| TW | 536123 | U | | 6/2003 |
| TW | 573751 | U | | 1/2004 |

* cited by examiner

ADJUSTABLE POSITIONING HINGE WITH HIGH TORSIONAL FRICTION AND ASSEMBLING METHOD THEREOF

CROSS-REFERENCE TO RELATED APPLICATION

This application claims priority to Taiwan Patent Application No. 106125858, filed on Aug. 1, 2017. The entire content of the above-mentioned application is incorporated herein by reference for all purposes.

FIELD OF THE INVENTION

The present invention relates to a positioning hinge, and more particularly to an adjustable positioning hinge with high torsional friction and an assembling method thereof.

BACKGROUND OF THE INVENTION

In order to provide the rotation function, doors and windows are usually connected to the objects (e.g. cabinets or doorframes) through the hinges. However, the conventional hinge is employed to provide the rotation function merely, but fails to position the door and the window relative to the object effectively at a specific angle. For some doors and windows implemented in a specific environment and frequently needing to be rotated upwardly and downwardly, the hinges employed to position the doors and windows have to provide enough torsional frictions, so that the doors and windows can be opened and kept at specific positioning angles. Consequently, the positioning hinges are developed to meet the requirements of the market.

Nowadays, the positioning hinge on the market is constructed by a friction damping piece, which is fitted in a hinge sleeve to rub against the circular shaft therein. Thus, the door and window can be opened and kept at a specific positioning angle by the torsional friction generated between the friction damping piece and the circular shaft. For generating the torsional friction between the friction damping piece and the circular shaft, the inner diameter of the friction damping piece is designed to be slightly smaller than the outer diameter of the circular shaft before being assembled. Since the friction damping piece has to be fitted in the hinge sleeve, it is not easy to assemble the positioning hinge and the frictional torque between the circular shaft and the corresponding hinge sleeve fails to be controlled or adjusted easily. Moreover, the torsional friction provided by the positioning hinge is limited by the structure and materials of the positioning hinge. Consequently, the positioning hinge fails to meet the practical requirement while a positioning hinge with high torsional friction is required for keeping the doors or windows at a required positioning angle in a specific environment.

Therefore, there is a need of providing an adjustable positioning hinge with high torsional friction and an assembling method thereof to meet the above requirements and solve the above problems.

SUMMARY OF THE INVENTION

An object of the present invention is to provide an adjustable positioning hinge with high torsional friction and an assembling method thereof. Plural friction damping pieces are selectively arranged to fit in a sleeve and fixed in the sleeve through a positioning pin and a positioning groove. Each friction damping piece has a positioning part received in the positioning groove of the sleeve and engaged with the positioning pin so as to be fixed in the sleeve. Consequently, the adjustable positioning hinge is assembled easily, the torsional friction between the plural friction damping pieces and the circular shaft can be adjusted and controlled according to the practical requirement, and the adjustable positioning hinge with high torsional friction is achieved. Further, since the arrangement of the plural friction damping pieces are adjustable, the difficulty of assembling is reduced, and the torsional friction between the friction damping pieces and the circular shaft is adjustable in different rotating directions. Moreover, the adjustable positioning hinge can provide different high torsional frictions for two opposite rotating directions.

Another object of the present invention is to provide an adjustable positioning hinge with high torsional friction and an assembling method thereof. The adjustable positioning hinge is employed to connect two objects together and allow relative pivotal movement between the connected objects. The adjustable positioning hinge allows one of the connected objects to maintain any of a variety of selectable position relative to the other of the connected objects. Consequently, one object of the connected objects can be rotated, free stop and position at any required angle relative to the other object of the connected objects. Further, the main elements of the adjustable positioning hinge can be manufactured by a metal casting method, so that the adjustable positioning hinge is provided with sufficient mechanical strength to bear the high torsional friction thereof and can be applicable to a cabin door of a yacht or a door of a cabinet, which needs high frictional torque to perform the functions of position.

In accordance with an aspect of the present invention, it provides an adjustable positioning hinge including a first leaf set, a second leaf set, a positioning pin and a shaft. The first leaf set includes a first sleeve. The first sleeve includes a first cylinder wall, a first channel and a positioning groove. The first channel runs through the first sleeve. The positioning groove is concavely formed on an inner surface of the first cylinder wall and disposed along an axial direction of the first sleeve. The positioning groove is in communication with the first channel. The plural friction damping pieces are fitted in the first channel of the first sleeve and configured to form at least one adjustable friction sleeve set. Each of the plural friction damping pieces includes a sleeving part and a positioning part. The sleeving part includes an end connected with the positioning part and a longitudinal edge rolled toward the positioning part. The positioning part is accommodated in the positioning groove. The positioning pin is accommodated in the positioning groove and engaged with the plural positioning parts accommodated in the positioning groove to position and fasten the plural positing parts. The shaft is fixed to the second leaf set. The first leaf set is pivotally connected with the second leaf set via the shaft and the plural friction damping pieces, so that the first leaf set and the second leaf set are rotatable and positioned relative to each other.

In accordance with another aspect of the present invention, it provides an assembling method of an adjustable positioning hinge. The assembling method includes steps of: (a) providing a first leaf set comprising a first sleeve, wherein the first sleeve comprises a first cylinder wall, a first channel and a positioning groove, wherein the first channel runs through the first sleeve, the positioning groove is concavely formed on an inner surface of the first cylinder wall and disposed along an axial direction of the first sleeve, and the positioning groove is in communication with the first channel; (b) providing plural friction damping pieces and fitting the plural friction damping pieces in the first channel of the first sleeve to form at least one adjustable friction sleeve set, wherein each of the plural damping pieces comprises a sleeving part and a positioning part, wherein the sleeving part includes an end connected with the positioning part and a longitudinal edge rolled toward the positioning part, wherein the positioning part is accommodated in the positioning groove; (c) providing a positioning pin and accommodating the positioning pin in the positioning groove to engage with the plural positioning parts accommodated in the positioning groove; and (d) providing a second leaf set and a shaft, fixing the shaft to the second leaf set and pivotally connecting the first leaf set with the second leaf set by installing the shaft into the plural friction damping pieces accommodated in the first sleeve of the first leaf set, so that the first leaf set and the second leaf set are rotatable and positioned relative to each other.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
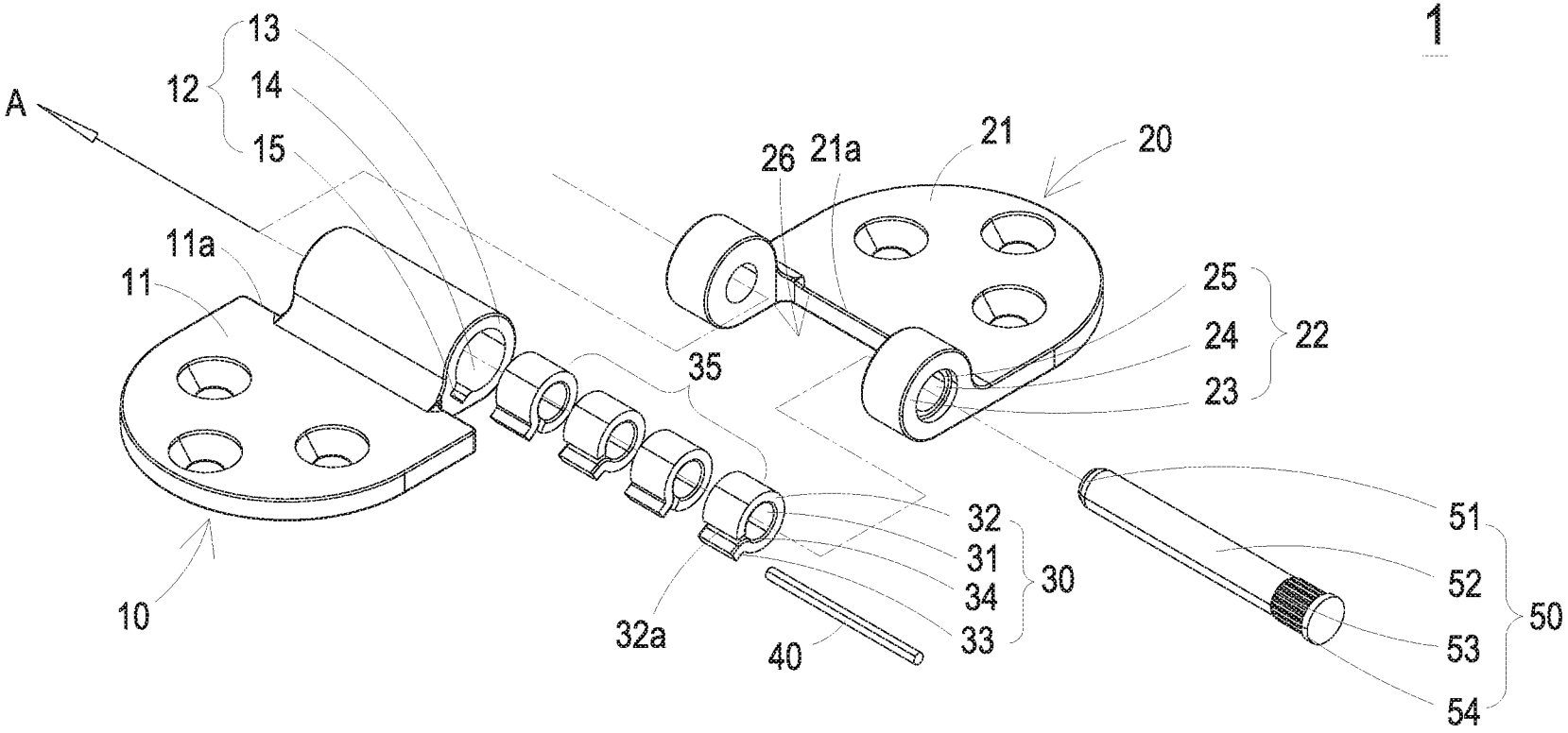
FIG. 1 is an exploded view illustrating an adjustable positioning hinge according to a first embodiment of the present invention.
Figure 2:
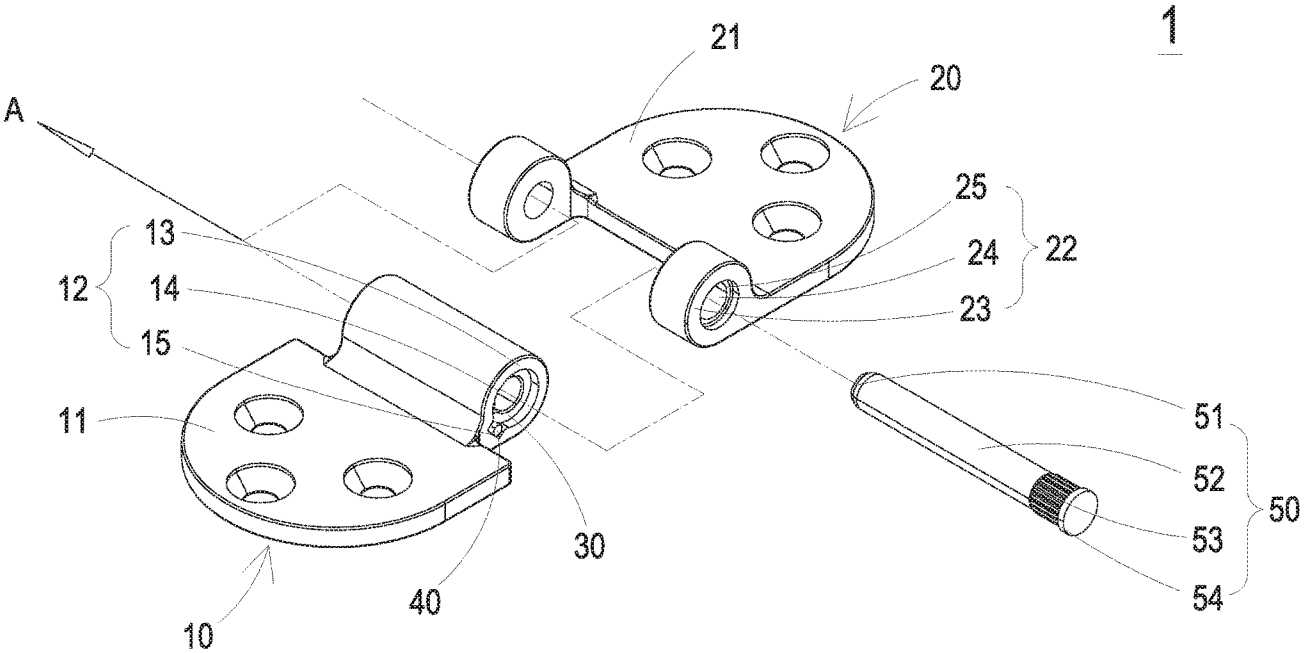
FIG. 2 is a partial exploded view illustrating the adjustable positioning hinge of FIG. 1.
Figure 3B:
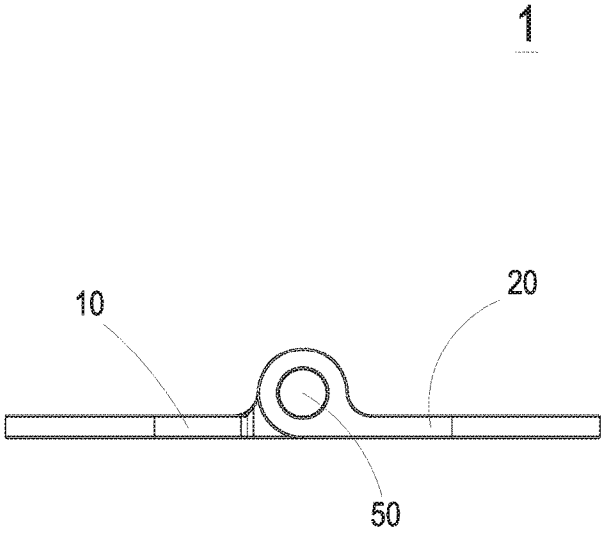
FIG. 3B is a lateral view illustrating the adjustable positioning hinge of FIG. 1.
Figure 3A:
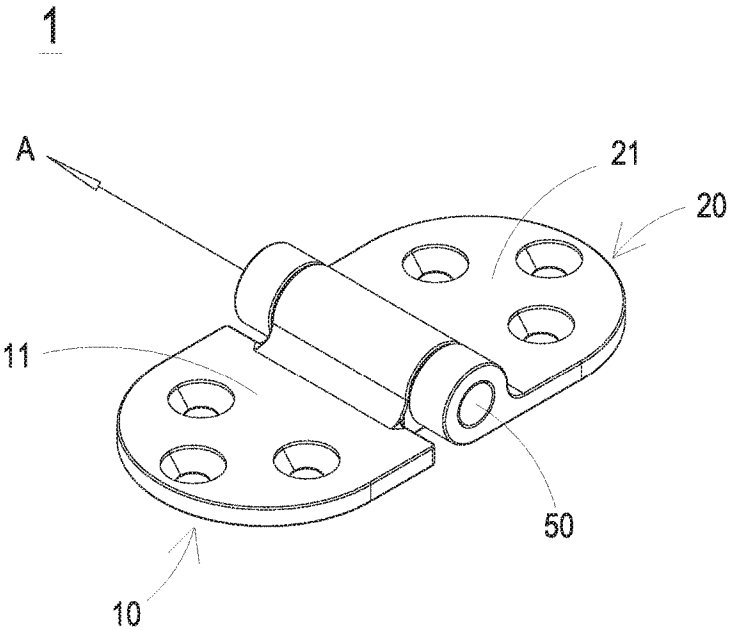
FIG. 3A is a structural view illustrating the adjustable positioning hinge of FIG. 0.1.
Figure 4B:
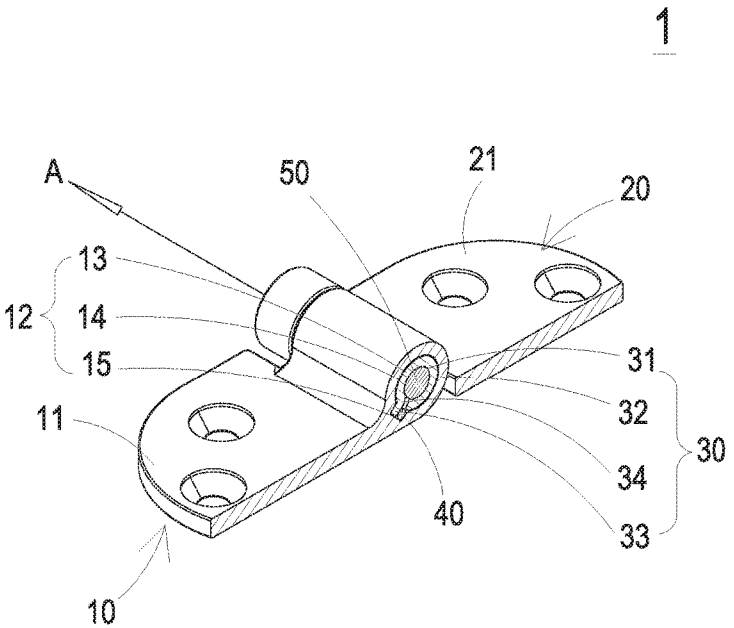
FIG. 4B is another cross-sectional view illustrating the adjustable positioning hinge of FIG. 1.
Figure 4A:
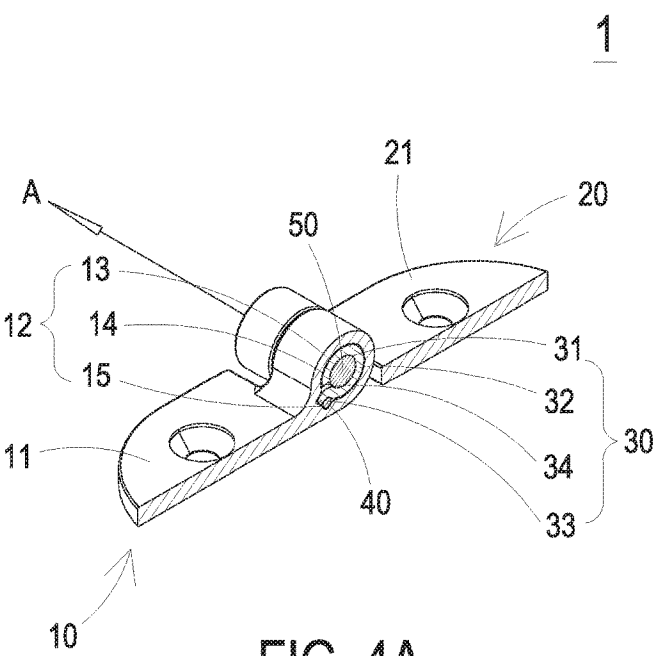
FIG. 4A is a cross-sectional view illustrating the adjustable positioning hinge of FIG. 1.

FIG. 1 is an exploded view illustrating an adjustable positioning hinge according to a first embodiment of the present invention. FIG. 2 is a partial exploded view illustrating the adjustable positioning hinge of FIG. 1. FIG. 3A is a structural view illustrating the adjustable positioning hinge of FIG. 1. FIG. 3B is a lateral view illustrating the adjustable positioning hinge of FIG. 1. FIG. 4A is a cross-sectional view illustrating the adjustable positioning hinge of FIG. 1. FIG. 4B is another cross-sectional view illustrating the adjustable positioning hinge of FIG. 1. As shown in FIGS. 1 to 4B, an adjustable positioning hinge 1 of the present invention includes a first leaf set 10, a second leaf set 20, plural friction damping pieces 30, a positioning pin 40 and a shaft 50. The first leaf set 10 includes a first plate 11 and a first sleeve 12. The first plate 11 has a first lateral edge 11*a*, and the first sleeve 12 is connected to the first lateral edge 11*a* of the first plate 11. The first sleeve 12 includes a first cylinder wall 13, a first channel 14 and a positioning groove 15. The first channel 14 is constructed by the first cylinder wall 13. Namely, the first channel 14 runs through the first sleeve 12. The positioning groove 15 is concavely formed on the inner surface of the first cylinder wall 13 and disposed along an axial direction A of the first sleeve 12. The positioning groove 15 is in communication with the first channel 14. The second leaf set 20 includes a second plate 21 and at least one second sleeve 22. Each second sleeve 22 includes a second cylinder wall 23 and a second channel 24. The second channel 24 is constructed by the second cylinder wall 23. Namely, the second channel 24 runs through the second sleeve 22. The second channel 24 of the second sleeve 22 is aligned with and in communication with the first channel 14 of the first sleeve 12. Moreover, the at least one second sleeve 22 and the first sleeve 12 are coaxial. Preferably but not exclusively, the second leaf set 20 includes two second sleeves 22. The second plate 21 has a second lateral edge 21*a*, and the two second sleeves 22 are connected to the second lateral edge 21*a* of the second plate 21 and spaced apart with each other to from a gap 26 therebetween. The first sleeve 12 is accommodated in the gap 26 between the two second sleeves 22. The second channels 24 of the two second sleeves 22 are aligned with and in communication with the first channel 14 of the first sleeve 12. The two second sleeves 22 and the first sleeve 12 are coaxial.

The friction damping pieces 30 are fitted in the first channel 14 of the first sleeve 12 and configured to form at least one adjustable friction sleeve set 35. Namely, each adjustable friction sleeve set 35 includes one or more friction damping pieces 30. The friction damping pieces 30 have the same structures, and each of the friction damping pieces 30 includes a third channel 31, a sleeving part 32, a positioning part 33 and a slit 34. The third channel 31 run through the sleeving part 32. The sleeving part 32 includes an end connected with the positioning part 33 and a longitudinal edge 32*a* rolled toward the positioning part 33. The positioning part 33 is extending outwardly from the end of the sleeving part 32. The positioning part 33 is accommodated in the positioning groove 15 of the first sleeve 12 when the friction damping piece 30 is fitted in the first channel 14 of the first sleeve 12. The slit 34 is formed between the longitudinal edge 32*a* of the sleeving part 32 and the junction portion of the sleeving part 32 and the positioning part 33. In this embodiment, the positioning pin 40 is accommodated in the positioning groove 15 of the first sleeve 12 and engaged with the positioning parts 33 of the friction damping piece 30 accommodated in the positioning groove 15. Consequently, the positing parts 33 of the friction damping pieces 30 are positioned and fastened.

The shaft 50 includes a connecting end 51, a pivoting axis 52, a fastening portion 53 and a stopping end 54. The connecting end 51 and the stopping end 54 are connected to two opposite ends of the pivoting axis 52. The fastening portion 53 is disposed between the stopping end 54 and the pivoting axis 52. In this embodiment, the pivoting axis 52 of the shaft 50 is pivotally connected with the first leaf set 10 through the friction damping pieces 30 of the at least one adjustable friction sleeve set 35. The fastening portion 53 of the shaft 50 is for example but not limited to engaging teeth, which is engaged with a fastening ring 25 disposed in the inner of the second cylinder wall 23 of the second sleeve 22 and located in the second channel 24. Consequently, the shaft 50 is fixed in the second leaf set 20. In the embodiment, the inner diameter of the fastening ring 25 is slighter smaller than the outer diameter of the fastening portion 53 before the fastening portion 53 is inserted into the fastening ring 25. While the shaft 50 is inserted into the second channel 24 of the second sleeve 22 and the fastening portion 53 of the shaft 50 passes through the fastening ring 25, the fastening portion 53 is engaged with the fastening ring 25 closely. Consequently, the shaft 50 is fixed by the second cylinder wall 23 of the second sleeve 22 of the second leaf set 20. Since the first sleeve 12 of the first leaf set 10 and the second sleeve 22 of the second leaf set 20 are coaxial and coupled with each other via the shaft 50, the first leaf set 10 and the second leaf set 20 is pivotally connected via the shaft 50 and can rotate relative to each other. Furthermore, one of the first leaf set 10 and the second leaf set 20 can be free stop and positioned at any required angle relative to the other of the first leaf set 10 and the second leaf set 20 by the frictional torque between the shaft 50 and the friction damping pieces 30 fitted in the first sleeve 12.

In the embodiment, the first leaf set 10 and the second leaf set 20 are respectively formed as one piece by for example but not limited to a metal casting process, so that the first leaf set 10 and the second leaf set 20 have sufficient mechanical strength to withstand the high frictional torque during the operation of the adjustable positioning hinge 1. The materials of the first leaf set 10 and the second leaf set 20 are for example but not limited to stainless steel with high mechanical strength. Preferably but not exclusively, the first leaf set 10 and the second leaf set 20 are constructed by a marine grade stainless steel 316 to resist the corrosive effects of chloride in seawater. In an embodiment, while the first leaf set 10 with sufficient mechanical strength is produced by a metal casting process, the positioning groove 15 is formed and disposed nearby the junction portion of the first plate 11 and the first sleeve 12 so as to reduce the entire size and save the materials. In the embodiment, each friction damping piece 30 of the adjustable friction sleeve set 35 has an inner diameter slighter smaller than an outer diameter of the shaft 50 before being assembled together. The slit 34 of the friction damping piece 30 is formed between the longitudinal edge 32*a* of the sleeving part 32 and the junction portion of the sleeving part 32 and the positioning part 33. The slit 34 is in communication with the third channel 31. Since the inner diameter of the friction damping piece 30 is slightly smaller than an outer diameter of pivoting axis 52 before being assembled together, while the pivoting axis 52 of the shaft 50 passes through the second channel 24 of the second sleeve 22 and further passes through the third channels 31 of the friction damping pieces 30 of the adjustable friction sleeve set 35, the friction damping pieces 30 and the pivoting axis 52 are rubbed against each other. Consequently, a high frictional torque is generated between the shaft 50 and the friction damping pieces 30 in the first sleeve 12 when the first leaf set 10 is rotated relative to the second leaf set 20. Consequently, the first leaf set 10 and the second leaf set 20 can be rotated and positioned relative to each other. It is noted that the inner diameter of the friction damping piece 30 of the adjustable friction sleeve set 35 is slightly smaller than an outer diameter of the pivoting axis 52 of the shaft 50 before the pivoting axis 52 of the shaft 50 is inserted in the friction damping pieces 30. Under this circumstance, when the pivoting axis 52 of the shaft 50 passes through the friction damping pieces 30 of the adjustable friction sleeve set 35 to rub against each other, the differences of the inner diameters of the friction damping piece 30 and the outer diameter of the pivoting axis 52 can be varied and adjusted. Consequently, it is facilitated to generate the high frictional torque between the shaft 50 and the friction damping pieces 30 in the first sleeve 12 when the first leaf set 10 is rotated relative to the second leaf set 20. Namely, the high frictional torque between the shaft 50 and the fraction damping pieces 30 in the first sleeve 12 is adjustable by changing the difference between the inner diameters of the fraction damping pieces 30 of the adjustable friction sleeve set 35 and the outer diameter of the pivoting axis 52 of the shaft 50. Consequently, the frictional torque of the adjustable positioning hinge 1 is adjustable according to the practical requirements. In an embodiment, the first leaf set 10 and the second leaf set 20 having frictional torque formed between the shaft 50 and the friction damping pieces 30 is ranged from 0.5 N·m to 100 N·m when the first leaf set 10 is rotated relative to the second leaf set 20. It is noted that the adjustable positioning hinge 1 with frictional torque in different range can be obtained by adjusting the corresponding dimensions, the constructing materials and the assembling structures and assembling methods. Preferably, the adjustable positioning hinge 1 having frictional torque formed between the shaft 50 and the friction damping pieces 30 is ranged from 0.5 N·m to 10 N·m when the first leaf set 10 is rotated relative to the second leaf set 20. Preferably but not exclusively, the adjustable positioning hinge 1 is applicable to a cabin door of a yacht or a door of a cabinet, which needs high frictional torque to perform the functions of position.

In an embodiment, when the friction damping pieces 30 are fitted and fixed in the first channel 14 of the first sleeve 12, the positioning parts 33 of the friction damping pieces 30 are received in the positioning groove 15 and the positioning pin 40 is accommodated in the positioning groove 15 and engaged with the positioning parts 33, and the slits 34 of any two adjacent friction damping pieces 30 are misaligned. Namely, the friction damping pieces 30 having the slits 34 facing toward a first direction (see FIGS. 1 and 4A) and the friction damping pieces 30 having the slits 34 facing toward a second direction (see FIGS. 1 and 4B) are disposed in a staggered arrangement along the axial direction A of the first sleeve 12. The positioning parts 33 of the friction damping pieces 30 having the slits 34 facing toward the first direction abut against one side of the positioning pin 40, and the positioning parts 33 of the friction damping pieces 30 having the slits 34 facing toward the second direction abut against the other side of the positioning pin 40. Preferably but not exclusively, the first direction and the second direction are opposite to each other. Consequently, the frictional torque formed between the shaft 50 and the friction damping pieces 30 in the first sleeve 12 is more uniform and stable when the first leaf set 10 is rotated relative to the second leaf set 20. Certainly, the arrangement of the friction damping pieces 30 fitted in the first sleeve 12 is not limited to the above embodiment and can be varied according to the practical requirements.

Figure 5:
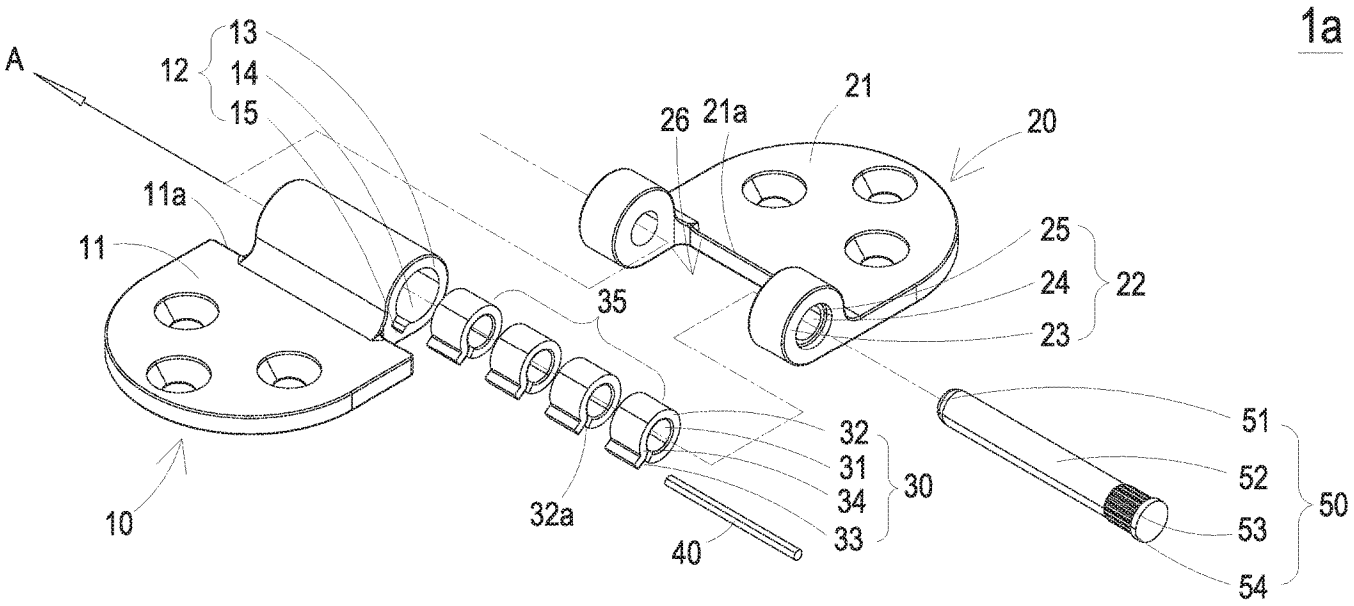
FIG. 5 is an exploded view illustrating an adjustable positioning hinge according to a second embodiment of the present invention.

FIG. 5 is an exploded view illustrating an adjustable positioning hinge according to a second embodiment of the present invention. In the embodiment, the structures, elements and functions of the adjustable positioning hinge 1*a* are similar to those of the adjustable positioning hinge 1 in FIGS. 1 to 4B, and are not redundantly described herein. Different from the adjustable positioning hinge 1 of FIGS. 1 to 4B, the arrangement of the friction damping pieces 30 in the first sleeve 12 is different. When the friction damping pieces 30 are fitted and fixed in the first channel 14 of the first sleeve 12, the positioning parts 33 of the friction damping pieces 30 are received in the positioning groove 15 and the positioning pin 40 is accommodated in the positioning groove 15 and engaged with the positioning parts 33, and the slits 34 of the friction damping pieces 30 are aligned with each other and in communication with each other. Namely, the friction damping pieces 30 having the slits 34 facing toward the same direction are disposed along the axial direction A of the first sleeve 12. The positioning parts 33 of the friction damping pieces 30 abut against the same side of the positioning pin 40. Consequently, the frictional torque formed between the shaft 50 and the friction damping pieces 30 in the first sleeve 12 is more uniform in one rotation direction when the first leaf set 10 is rotated relative to the second leaf set 20. Certainly, the arrangement of the friction damping pieces 30 fitted in the first sleeve 12 is not limited to the above embodiment and can be varied according to the practical requirements. Moreover, the inner diameter of the adjustable friction sleeve set 35 is adjustable by varying and adjusting the inner diameters of the friction damping pieces 30. Different arrangements of the friction damping pieces 30 are implemented to increase the variety of the frictional torque of the adjustable positioning hinge 1*a*. Consequently, the applicability and the competitiveness of the adjustable positioning hinge 1*a* is enhanced.

Figure 6:
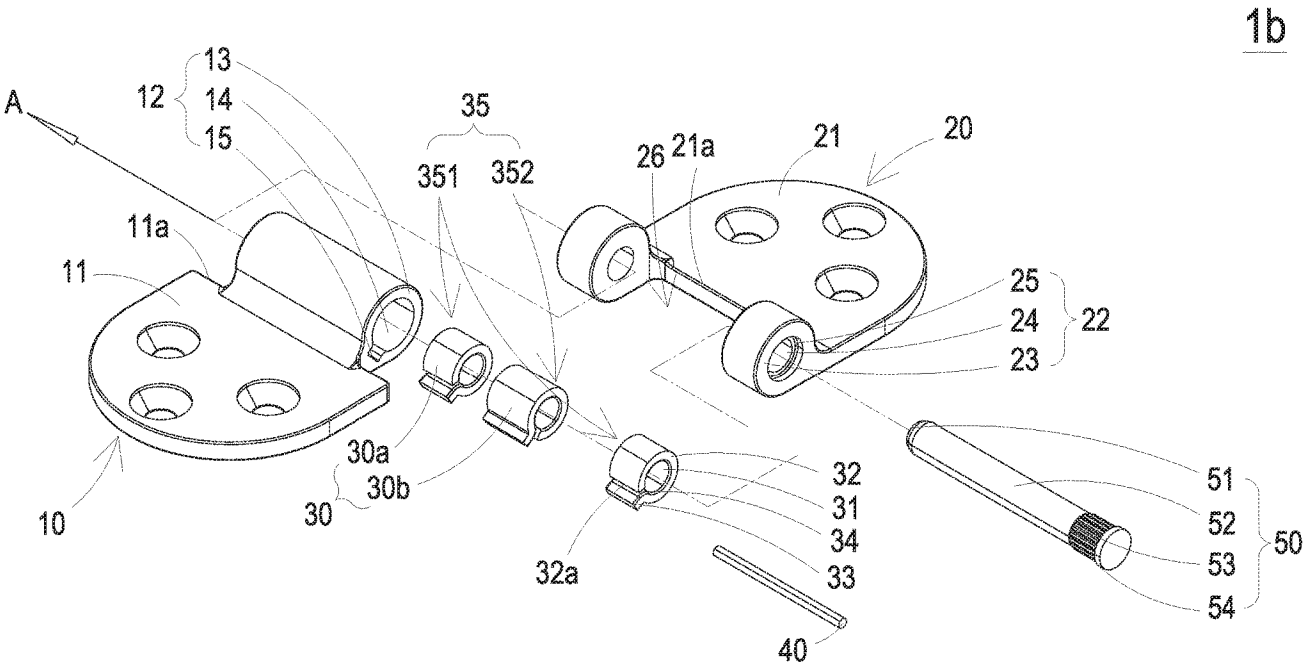
FIG. 6 is an exploded view illustrating an adjustable positioning hinge according to a third embodiment of the present invention.
Figure 7:
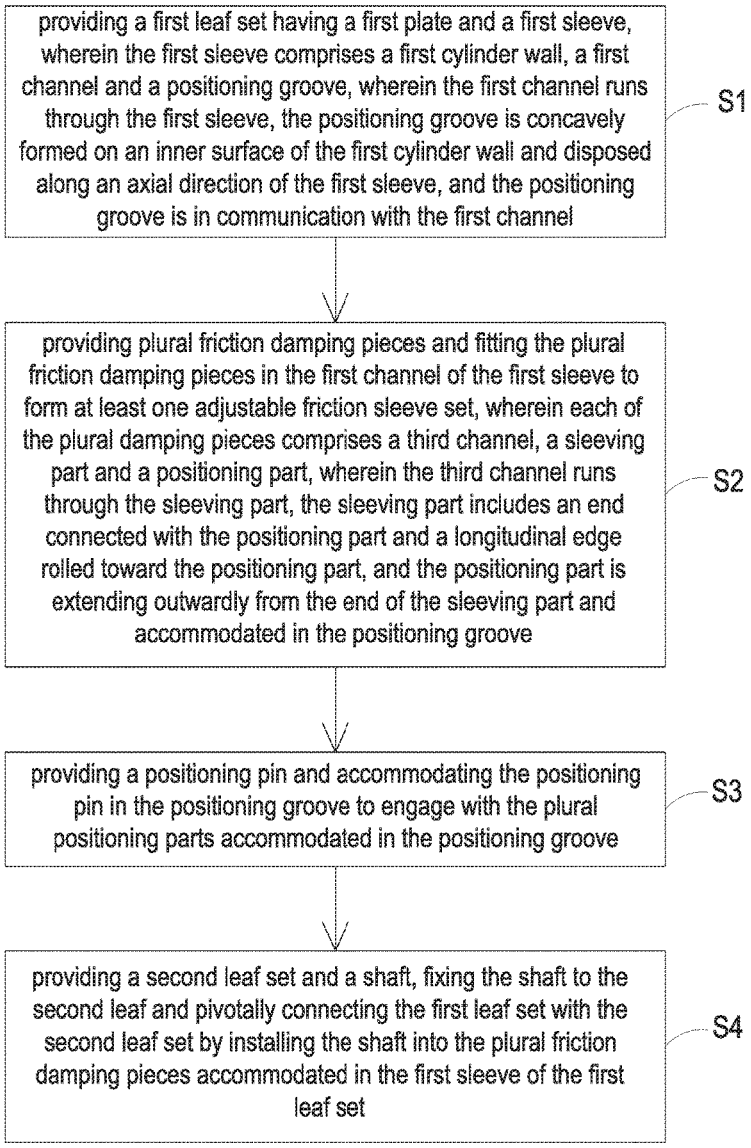
FIG. 7 is a flow chart showing an assembling method of an adjustable positioning hinge according to the present invention.

FIG. 6 is an exploded view illustrating an adjustable positioning hinge according to a third embodiment of the present invention. In the embodiment, the structures, elements and functions of the adjustable positioning hinge 1*b* are similar to those of the adjustable positioning hinge 1 in FIGS. 1 to 4B, and are not redundantly described herein. Different from the adjustable positioning hinge 1 of FIGS. 1 to 4B, the adjustable positioning hinge 1*b* includes two adjustable friction sleeve sets 35 for example a first adjustable friction sleeve set 351 and a second adjustable friction sleeve set 352. The first adjustable friction sleeve set 351 includes plural first friction damping pieces 30*a* and the second adjustable friction sleeve set 352 includes at least one second friction damping piece 30*b*. All of the first friction damping pieces 30*a* and the second friction damping pieces 30*b* have same structures, but the length of the second friction damping piece 30*b* of the second adjustable friction sleeve set 352 is different with that of the first friction damping piece 30*a* of the first adjustable friction sleeve set 351. Namely, the length of the second friction damping piece 30*b* of the second adjustable friction sleeve set 352 is larger than that of the first friction damping piece 30*a* of the first adjustable friction sleeve set 351. In this embodiment, the first adjustable friction sleeve set 351 includes two first friction damping pieces 30*a*, and the second adjustable friction sleeve set 352 includes one second friction damping piece 30*b*. The second friction damping piece 30*b* of the second adjustable friction sleeve set 352 is disposed between the two first friction damping pieces 30*a* of the first adjustable friction sleeve set 351. Namely, the first friction damping pieces 30*a* of the first adjustable friction sleeve set 351 and the second friction damping piece 30*b* of the second adjustable friction sleeve set 352 are disposed in a staggered arrangement and fitted in the first channel 14 of the first sleeve 12.

Each of the first friction damping pieces 30*a* of the first adjustable friction sleeve set 351 and the second friction damping piece 30*b* of the second adjustable friction sleeve set 352 includes a third channel 31, a sleeving part 32, a positioning part 33 and a slit 34. The third channel 31 runs through the sleeving part 32. The sleeving part 32 includes an end connected with the positioning part 33 and a longitudinal edge 32*a* rolled toward the positioning part 33. The positioning part 33 is extending outwardly from the end of the sleeving part 32. The positioning part 33 is accommodated in the positioning groove 15 of the first sleeve 12 when the first friction damping pieces 30*a* and the second friction damping piece 30*b* are fitted in the first channel 14 of the first sleeve 12. The slit 34 is formed between the longitudinal edge 32*a* of the sleeving part 32 and the junction portion of the sleeving part 32 and the positioning part 33. In this embodiment, the positioning pin 40 is accommodated in the positioning groove 15 of the first sleeve 12 and engaged with the positioning parts 33 accommodated in the positioning groove 15. Consequently, the positioning parts 33 of the friction damping pieces 30 are positioned and fastened.

In the embodiment, each of the first friction damping pieces 30*a* of the first adjustable friction sleeve set 351 and the second friction damping piece 30*b* of the second adjustable friction sleeve set 352 has an inner diameter slightly smaller than an outer diameter of the pivoting axis 52 of the shaft 50 before the pivoting axis 52 of the shaft 50 is inserted in each of the first friction damping pieces 30*a* of the first adjustable friction sleeve set 351 and the second friction damping piece 30*b* of the second adjustable friction sleeve set 352. After the pivoting axis 52 of the shaft 50 passes through the first friction damping pieces 30*a* of the first adjustable friction sleeve set 351 and the second friction damping piece 30*b* of the second adjustable friction sleeve set 352, a high frictional torque is generated between the shaft 50 and the first friction damping pieces 30*a* and the second friction damping piece 30*b* in the first sleeve 12 when the first leaf set 10 is rotated relative to the second leaf set 20. Consequently, the first leaf set 10 and the second leaf set 20 can be rotated and positioned relative to each other. In an embodiment, the inner diameter of each first friction damping piece 30*a* of the first adjustable friction sleeve set 351 is slightly smaller than the inner diameter of the second friction damping piece 30*b* of the second adjustable friction sleeve set 352, and the length of each first friction damping piece 30*a* of the first adjustable friction sleeve set 351 is smaller than that of the second friction damping piece 30 of the second adjustable friction sleeve set 352 along the axial direction A of the first sleeve 12. Under this circumstance, when the pivoting axis 52 of the shaft 50 passes through the first friction damping pieces 30*a* of the first adjustable friction sleeve set 351 and the second friction damping piece 30*b* of the second adjustable friction sleeve set 352, by adjusting the arrangement of the first friction damping pieces 30*a* of the first adjustable friction sleeve set 351 and the second friction damping piece 30*b* of the second adjustable friction sleeve set 352, the frictional torque formed between the first friction damping pieces 30*a*, the second friction damping piece 30*b* and the shaft 50 is adjustable. For example, the adjustable positioning hinge 1*b* with frictional torques in various range can be achieved by varying or adjusting the arrangements and the lengths of the first friction damping pieces 30*a* and the second friction damping piece 30*b*. Consequently, the applicability and the competitiveness of the adjustable positioning hinge 1*b* is enhanced.

In an embodiment, the first friction damping pieces 30*a* of the first adjustable friction sleeve set 351 having the slits 34 facing toward a first direction, and the second friction damping piece 30*b* of the second adjustable friction sleeve set 352 has the slit 34 facing toward a second direction. Namely, the positioning parts 33 of the first friction damping pieces 30*a* abut against one side of the positioning pin 40, and the positioning parts 33 of the second friction damping pieces 30*b* abut against the other side of the positioning pin 40. Alternatively, the first friction damping pieces 30*a* of the first adjustable friction sleeve set 351 and the second friction damping piece 30*b* of the second adjustable friction sleeve set 352 have the slits 34 facing toward the same direction. Namely, the positioning parts 33 of the first friction damping pieces 30*a* and the positioning parts 33 of the second friction damping pieces 30*b* abut against the same side of the positioning pin 40.

According to the adjustable positioning hinge 1 described in the above embodiments, an assembling method of the adjustable positioning hinge is also provided. As shown in FIGS. 1 to 4 and FIG. 7, the method of assembling the adjustable positioning hinge 1 includes the following steps. Firstly, a first leaf set 10 is provided (see step S1). The first leaf set 10 includes a first plate 11 and a first sleeve 12. The first sleeve 12 includes a first cylinder wall 13, a first channel 14 and a positioning groove 15. The first channel 14 is constructed by the first cylinder wall 13. Namely, the first channel 14 runs through the first sleeve 12. The positioning groove 15 is concavely formed on the inner surface of the first cylinder wall 13 and disposed along an axial direction A of the first sleeve 12. The positioning groove 15 is in communication with the first channel 14.

Then, plural friction damping pieces 30 are provided and fitted in the first channel 14 of the first sleeve 12 and configured to form at least one adjustable friction sleeve set 35 (see step S2). Namely, each adjustable friction sleeve set 35 includes one or more friction damping pieces 30. In the embodiment, the friction damping pieces 30 have the same structures, and each of the friction damping piece 30 includes a third channel 31, a sleeving part 32, a positioning part 33 and a slit 34. The third channel 31 runs through the sleeving part 32. The sleeving part 32 includes an end connected with the positioning part 33 and a longitudinal edge 32*a* rolled toward the positioning part 33. The positioning part 33 is extending outwardly from the end of the sleeving part 32, and accommodated in the positioning groove 15 of the first sleeve 12 when the friction damping piece 30 is fitted in the first channel 14 of the first sleeve 12. The slit 34 is formed between the longitudinal edge 32*a* of the sleeving part 32 and the junction portion of the sleeving part 32 and the positioning part 33.

Thereafter, a positioning pin 40 is provided, accommodated in the positioning groove 15 of the first sleeve 12 and engaged with the positioning parts 33 accommodated in the positioning groove 15. Consequently, the positing parts 33 of the friction damping pieces 30 are positioned and fastened (see step S3).

Finally, a second leaf set 20 and a shaft 50 are provided. The shaft 50 is fixed to the second leaf set 20, and the first leaf set 10 is pivotally connected with the second leaf set 20 by installing the shaft 50 into the plural friction damping pieces 30 accommodated in the first sleeve 12 of the first leaf set 10 (see step S4). Consequently, the adjustable positioning hinge 1 is assembled, and the first leaf set 10 and the second leaf set 20 are rotatable and positioned relative to each other. In the embodiment, the second leaf set 20 includes a second plate 21 and at least one second sleeve 22. Each second sleeve 22 includes a second cylinder wall 23 and a second channel 24. The second channel 24 is constructed by the second cylinder wall 23. Namely, the second channel 24 runs through the second cylinder wall 23. The second channel 24 of the second sleeve 22 is aligned with and in communication with the first channel 14 of the first sleeve 12. Moreover, the at least one second sleeve 22 and the first sleeve 12 are coaxial. Preferably but not exclusively, the second leaf set 20 includes two second sleeves 22. The second plate 21 has a second lateral edge 21*a*, and the two second sleeves 22 are connected to the second lateral edge 21*a* of the second plate 21 and spaced apart with each other to from a gap 26 therebetween. In an embodiment, the step S4 includes the following sub-steps. Firstly, the first sleeve 12 of the first leaf set 10 is accommodated in the gap 26 between the two second sleeves 22 of the second leaf set 20, and the second channels 24 of the two second sleeves 22 are aligned with and in communication with the third channels 31 of the friction damping pieces 30 accommodated in the first sleeve 12 of the first leaf set 10. Namely, the two second sleeves 22 and the first sleeve 12 are coaxial. Then, the connecting end 51 of the shaft 50 passes through the front one of the second channels 24, the third channels 31 and the rear one of the second channels 24 sequentially and is connected with the rear one of the second sleeves 22. The pivoting axis 52 of the shaft 50 passes through the front one of the second channels 24 and the third channels 31 sequentially and is connected with the friction damping pieces 30. The fastening portion 53 of the shaft 50 passes through the front one of the second channels 24 and is connected with and fixed to the front one of the second sleeves 22 via a fastening ring 25 disposed in the inner of the second cylinder wall 23 of the second sleeve 22. The stopping end 54 of the shaft 50 is fixed on the front one of the second sleeves 22 by for example but not limited to an adhesive. Consequently, the shaft 50 is fixed to the second leaf set 20, and the first leaf set 10 is pivotally connected with the second leaf set 20 via the shaft 50 and the plural friction damping pieces 30. In this embodiment, the fastening portion 53 can be for example but not limited to engaging teeth, which is engaged with the fastening ring 25 disposed in the inner of the second cylinder wall 23 of the second sleeve 22 and located in the second channel 24, so that the shaft 50 is fixed to the second leaf set 20. Since the first sleeve 12 of the first leaf set 10 and the second sleeve 22 of the second leaf set 20 are coaxial, the first leaf set 10 and the second leaf set 20 are rotatable relative to each other and positioned by the frictional torque formed between the shaft 50 and the friction damping pieces 30 fitted in the first sleeve 12. In the embodiment, the first leaf set 10 and the second leaf set 20 have the frictional torque configured by the shaft 50 and the plural friction damping pieces 30 when the first leaf set 10 and the second leaf set 20 rotate relative to each other. Preferably but not exclusively, the frictional torque is ranged from 0.5 N·m to 100 N·m. The adjustable positioning hinge 1 with high frictional torque in different range can be achieved by adjusting the corresponding dimensions, the materials and the assembling method. More perfectly, the frictional torque configured by the shaft 50 and the plural friction damping pieces 30 between the first leaf set 10 and the second leaf set 20 is ranged from 0.5 N·m to 10 N·m. It is noted that the range of the frictional torque is not limited to the above embodiments and is adjustable according to the practical requirements by adjusting the corresponding dimensions, the materials and the assembling method.

In the embodiment, the inner diameter of the friction damping piece 30 of the adjustable friction sleeve set 35 is slightly smaller than an outer diameter of the pivoting axis 52 of the shaft 50 before the pivoting axis 52 of the shaft 50 is inserted in the friction damping pieces 30. Under this circumstance, while the pivoting axis 52 of the shaft 50 passes through the plural friction damping pieces 30 of the adjustable friction sleeve set 35, the friction damping pieces 30 and the pivoting axis 52 are rubbed against each other. Thus, a high frictional torque is generated between the shaft 50 and the plural friction damping pieces 30 in the first sleeve 12 when the first leaf set 10 is rotated relative to the second leaf set 20. It is noted that the size, the inner diameter and the arrangement of the plural friction damping pieces 30 fitted in the first sleeve 12 are adjustable according to the practical requirements. In FIG. 6, the adjustable positioning hinge 1*b* includes two adjustable friction sleeve sets 35 for example a first adjustable friction sleeve set 351 and a second adjustable friction sleeve set 352. The first adjustable friction sleeve set 351 includes plural first friction damping pieces 30*a* and the second adjustable friction sleeve set 352 includes at least one second friction damping piece 30*b*. Since the length and the inner diameter of the second friction damping piece 30*b* of the second adjustable friction sleeve set 352 are different with those of the first friction damping piece 30*a* of the first adjustable friction sleeve set 351, the second adjustable friction sleeve set 352 and the first adjustable friction sleeve set 351 can be employed to form different frictional torques in different sections and different directions when the first leaf set 10 is rotated relative to the second leaf set 20.

Figure 8B:
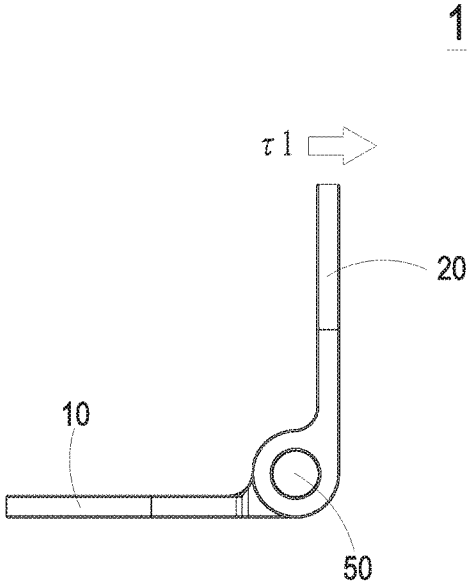
FIG. 8B is a lateral view of FIG. 8A.
Figure 8A:
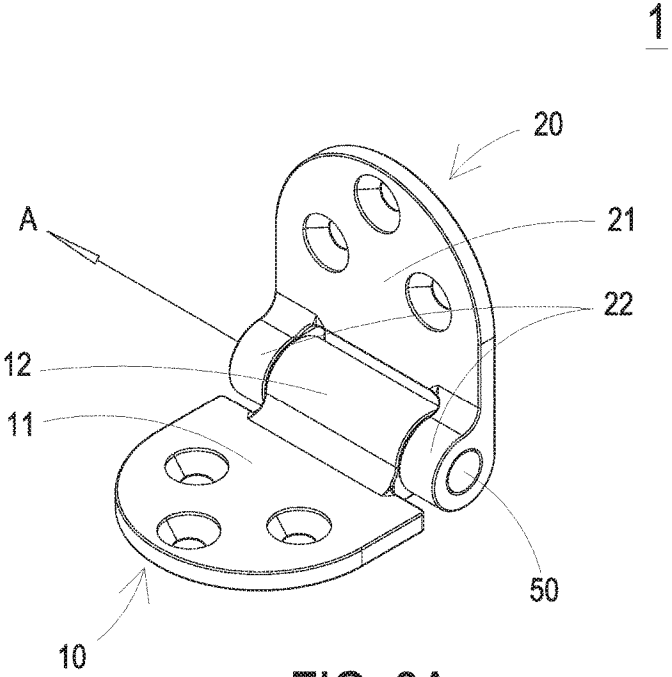
FIG. 8A shows a positioning status of the adjustable positioning hinge of FIG. 6.
Figure 9B:
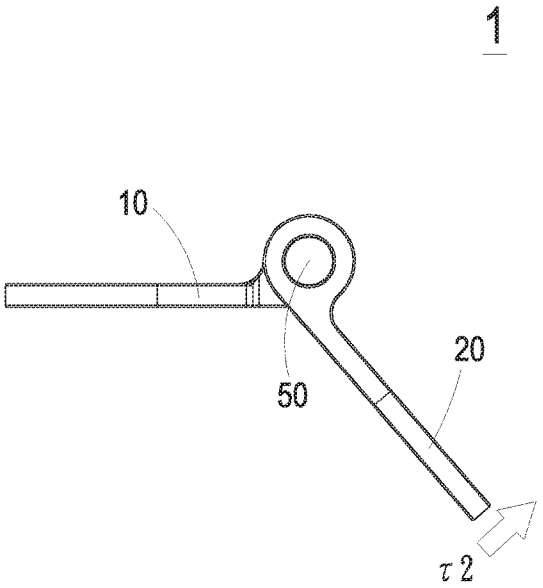
FIG. 9B is a lateral view of FIG. 9A.
Figure 9A:
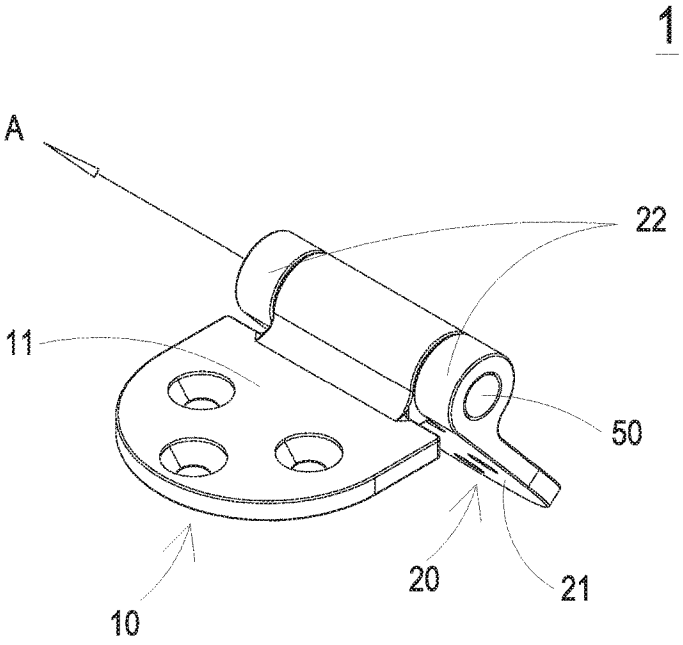
FIG. 9A shows another positioning status of the adjustable positioning hinge of FIG. 6.

FIG. 8A shows a positioning status of the adjustable positioning hinge of FIG. 6. FIG. 8B is a lateral view of FIG. 8A. FIG. 9A shows another positioning status of the adjustable positioning hinge of FIG. 6. FIG. 9B is a lateral view of FIG. 9A. An assembly of the adjustable positioning hinge 1*b* of FIG. 6 can be regarded as the same one of FIGS. 3A and 3B, wherein the first leaf set 10 and the second leaf set 20 are horizontal to each other. For rotating the first leaf set 10 and the second leaf set 20 relative to each other and changing the original horizontal status to a specific positioning status as shown in FIGS. 8A and 8B, the user must force to overcome a first frictional torque $\tau 1$. Alternatively, for rotating the first leaf set 10 and the second leaf set 20 relative to each other and changing the original horizontal status to a specific positioning status as shown in FIGS. 9A and 9B, the user must force to overcome a second frictional torque $\tau 2$. In the embodiment, the first frictional torque $\tau 1$ is greater than the second frictional torque $\tau 2$. It is noted that the size, inner diameter, number, type and the arrangement of the plural fraction damping pieces 30 of the adjustable friction sleeve set 35 are not limited to the above embodiments and can be varied according to the practical requirements.

In summary, an adjustable positioning hinge with high torsional friction and an assembling method thereof are provided. Plural friction damping pieces are selectively arranged to fit in a sleeve and fixed in the sleeve through a positioning pin and a positioning groove. Consequently, the adjustable positioning hinge is assembled easily, the torsional friction between the plural friction damping pieces and the circular shaft can be adjusted and controlled according to the practical requirement, and the adjustable positioning hinge with high torsional friction is achieved. Further, each friction damping piece has a positioning part received in the positioning groove and engaged with the positioning pin so as to be fixed in the sleeve. Consequently, the difficulty of assembling is reduced, and the torsional friction between the plural friction damping pieces and the circular shaft is adjustable in different rotating directions. In addition, the adjustable positioning hinge can provide different high torsional frictions for two opposite rotating directions. Furthermore, the adjustable positioning hinge is employed to connect two objects together and allow relative pivotal movement between the connected objects. The adjustable positioning hinge allows one of the connected objects to maintain any of a variety of selectable position relative to the other of the connected objects. Consequently, one object of the connected objects can be rotated, free stop and position at any required angle relative to the other object of the connected objects. Further, the main elements of the adjustable positioning hinge can be manufactured by a metal casting method, so that the adjustable positioning hinge is provided with sufficient mechanical strength to bear the high torsional friction thereof.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An adjustable positioning hinge, comprising:

a first leaf set comprises a first sleeve, wherein the first sleeve comprises a first cylinder wall, a first channel and a positioning groove, wherein the first channel runs through the first sleeve, the positioning groove is concavely formed on an inner surface of the first cylinder wall and disposed along an axial direction of the first sleeve, and the positioning groove is in communication with the first channel;

a second leaf set;

plural friction damping pieces fitted in the first channel of the first sleeve and configured to form at least one adjustable friction sleeve set, wherein each of the plural friction damping pieces comprises a sleeving part and a positioning part, wherein the sleeving part includes an end connected with the positioning part and a longitudinal edge rolled toward the positioning part, wherein the positioning part is accommodated in the positioning groove;

a positioning pin accommodated in the positioning groove and engaged with the plural positioning parts accommodated in the positioning groove to position and fasten the plural positing parts; and a shaft fixed to the second leaf set, wherein the first leaf set is pivotally connected with the second leaf set via the shaft and the plural friction damping pieces, so that the first leaf set and the second leaf set are rotatable and positioned relative to each other.

2. The adjustable positioning hinge according to claim 1, wherein the first leaf set further comprises a first plate having a first lateral edge, and the first sleeve is connected to the first lateral edge of the first plate, wherein the positioning groove is formed and disposed nearby a junction portion of the first plate and the first sleeve.

3. The adjustable positioning hinge according to claim 1, wherein the second leaf set comprises a second plate and at least one second sleeve, wherein each of the at least one second sleeve comprises a second cylinder wall and a second channel, and the second channel runs through the second sleeve, wherein the second channel of the at least one second sleeve is aligned with and in communication with the first channel of the first sleeve, wherein the at least one second sleeve is coaxial with the first sleeve, and the shaft is fixed by the second cylinder wall of the at least one second sleeve.

4. The adjustable positioning hinge according to claim 3, wherein each of the plural friction damping pieces comprises a third channel and a slit, wherein the third channel runs through the sleeving part, and the slit is formed between the longitudinal edge of the sleeving part and a junction portion of the sleeving part and the positioning part, wherein the positioning part is extending outwardly from the end of the sleeving part, and the slit is in communication with the third channel.

5. The adjustable positioning hinge according to claim 4, wherein the plural friction damping pieces have the same structures, and each of the plural friction damping pieces of the adjustable friction sleeve set includes an inner diameter slightly smaller than an outer diameter of the shaft before the shaft and the friction damping pieces are assembled together.

6. The adjustable positioning hinge according to claim 4, wherein the positioning parts of the plural friction damping pieces are accommodated in the positioning groove, the plural friction damping pieces having the slits facing toward the same direction, wherein the slits of the plural friction damping pieces are aligned with each other and in communication with each other.

7. The adjustable positioning hinge according to claim 4, wherein the positioning parts of the plural friction damping pieces are accommodated in the positioning groove, and the slits of any two adjacent friction damping pieces are misaligned with each other, wherein the friction damping pieces having the slits facing toward a first direction and the friction damping pieces having the slits facing toward a second direction are disposed in a staggered arrangement along the axial direction of the first sleeve.

8. The adjustable positioning hinge according to claim 1, wherein the at least one adjustable friction sleeve set comprises a first adjustable friction sleeve set and a second friction adjustable sleeve set, wherein the first adjustable friction sleeve set comprises at least two first friction damping pieces and the second adjustable friction sleeve set comprises at least one second friction damping pieces, wherein the at least two first friction damping pieces and the at least one second friction damping piece are disposed in a staggered arrangement and fitted in the first channel of the first sleeve, wherein the at least one second friction damping piece is disposed between the at least two first friction damping pieces.

9. The adjustable positioning hinge according to claim 8, wherein each of the at least two first friction damping pieces of the first adjustable friction sleeve set and each of the at least one second friction damping piece of the second adjustable friction sleeve have the same structure, and a length of the first friction damping piece is smaller than a length of the second friction damping piece.

10. The adjustable positioning hinge according to claim 9, wherein each of the first adjustable friction sleeve set and the second adjustable friction sleeve set includes an inner diameter slightly smaller than an outer diameter of the shaft before the shaft and the friction damping pieces are assembled together, wherein the inner diameter of the second adjustable friction sleeve set is slightly smaller than the inner diameter of the first adjustable friction sleeve set.

11. The adjustable positioning hinge according to claim 1, wherein the first leaf set is pivotally connected with the second leaf set via the shaft and the plural friction damping pieces to form the adjustable positioning hinge with a specific frictional torque, wherein the specific frictional torque is ranged from 0.5 N·m to 10 N·m.

12. The adjustable positioning hinge according to claim 1, wherein the first leaf set and the second leaf set are respectively formed as one piece by a metal casting process.

13. An assembling method of an adjustable positioning hinge, comprising steps of:

(a) providing a first leaf set comprising a first sleeve, wherein the first sleeve comprises a first cylinder wall, a first channel and a positioning groove, wherein the first channel runs through the first sleeve, the positioning groove is concavely formed on an inner surface of the first cylinder wall and disposed along an axial direction of the first sleeve, and the positioning groove is in communication with the first channel;

(b) providing plural friction damping pieces and fitting the plural friction damping pieces in the first channel of the first sleeve to form at least one adjustable friction sleeve set, wherein each of the plural damping pieces comprises a sleeving part and a positioning part, wherein the sleeving part includes an end connected with the positioning part and a longitudinal edge rolled toward the positioning part, wherein the positioning part is accommodated in the positioning groove;

(c) providing a positioning pin and accommodating the positioning pin in the positioning groove to engage with the plural positioning parts accommodated in the positioning groove; and (d) providing a second leaf set and a shaft, fixing the shaft to the second leaf set and pivotally connecting the first leaf set with the second leaf set by installing the shaft into the plural friction damping pieces accommodated in the first sleeve of the first leaf set, so that the first leaf set and the second leaf set are rotatable and positioned relative to each other.

14. The assembling method of an adjustable positioning hinge according to claim 13, wherein the second leaf set comprises a second plate and at least one second sleeve, wherein each of the at least one second sleeve comprises a second cylinder wall and a second channel, and the second channel runs through the second sleeve, wherein the step (d) further comprises a step of (d0) aligning the second channel of the at least one second sleeve to an end of the first channel of the first sleeve, wherein the at least one second sleeve is coaxial and in communication with the first sleeve.

15. The assembling method of an adjustable positioning hinge according to claim 13, wherein each of the plural friction damping pieces comprises a third channel and a slit, wherein the third channel runs through the sleeving part, and the slit is formed between the longitudinal edge of the sleeving part and a junction portion of the sleeving part and the positioning part, wherein the positioning part is extending outwardly from the end of the sleeving part and the slit is in communication with the third channel.

16. The assembling method of an adjustable positioning hinge according to claim 15, wherein the positioning parts of the plural friction damping pieces are accommodated in the positioning groove, the plural friction damping pieces having the slits facing toward the same direction, wherein the slits of the plural friction damping pieces are aligned with each other and in communication with each other.

17. The assembling method of an adjustable positioning hinge according to claim 13, wherein the at least one adjustable friction sleeve set comprises a first adjustable friction sleeve set and a second friction adjustable sleeve set, wherein the first adjustable friction sleeve set comprises at least two first friction damping pieces and the second adjustable friction sleeve set comprises at least one second friction damping pieces, wherein the at least two first friction damping pieces and the at least one second friction damping piece are disposed in a staggered arrangement and fitted in the first channel of the first sleeve, wherein the at least one second friction damping piece is disposed between the at least two first friction damping pieces.

18. The assembling method of an adjustable positioning hinge according to claim 17, wherein each of the at least two first friction damping pieces of the first adjustable friction sleeve set and each of the at least one second friction damping piece of the second adjustable friction sleeve have the same structure, and a length of the first friction damping piece is smaller than a length of the second friction damping piece.

19. The assembling method of an adjustable positioning hinge according to claim 17, wherein each of the first adjustable friction sleeve set and the second adjustable friction sleeve set includes an inner diameter slightly smaller than an outer diameter of the shaft before the shaft and the friction damping pieces are assembled together, wherein the inner diameter of the second adjustable friction sleeve set is slightly smaller than the inner diameter of the first adjustable friction sleeve set.

20. The assembling method of an adjustable positioning hinge according to claim 13, wherein the first leaf set is pivotally connected with the second leaf set via the shaft and the plural friction damping pieces to form the adjustable positioning hinge with a specific frictional torque, wherein the specific frictional torque is ranged from 0.5 N·m to 10 N·m, wherein the first leaf set and the second leaf set are respectively formed as one piece by a metal casting process.

* * * * *